US012358683B2

(12) United States Patent
Yerly et al.

(10) Patent No.: US 12,358,683 B2
(45) Date of Patent: Jul. 15, 2025

(54) RECYCLABLE CONTAINER COMPRISING A CARDBOARD-BASED SOCKET ELEMENT AND A PAPER-BASED RECEPTACLE ELEMENT

(71) Applicant: SOCIETE DES PRODUITS NESTLE S.A., Vevey (CH)

(72) Inventors: Fabrice Yerly, Montreux (CH); Tristan Jauzein, Territet (CH); Jennifer Destefanis, Fribourg (CH); Alexey Vishtal, Lausanne (CH)

(73) Assignee: Societe des Produits Nestle S.A., Vevey (CH)

( * ) Notice: Subject to any disclaimer, the term of this patent is extended or adjusted under 35 U.S.C. 154(b) by 300 days.

(21) Appl. No.: 18/246,751

(22) PCT Filed: Sep. 22, 2021

(86) PCT No.: PCT/EP2021/075991

§ 371 (c)(1),
(2) Date: Mar. 27, 2023

(87) PCT Pub. No.: WO2022/069302

PCT Pub. Date: Apr. 7, 2022

(65) Prior Publication Data

US 2023/0365297 A1 Nov. 16, 2023

(30) Foreign Application Priority Data

Sep. 30, 2020 (EP) ..... 20199310

(51) Int. Cl.
*B65D 5/72* (2006.01)
*B65D 65/42* (2006.01)

(52) U.S. Cl.
CPC ..... *B65D 5/726* (2013.01); *B65D 65/42* (2013.01); *B65D 2565/386* (2013.01)

(58) Field of Classification Search
CPC ... B65D 5/726; B65D 65/42; B65D 2565/386
USPC ..... 222/566
See application file for complete search history.

(56) References Cited

U.S. PATENT DOCUMENTS

| | | | | |
|---|---|---|---|---|
| 3,735,915 | A | 5/1973 | Fuss | |
| 4,120,420 | A | 10/1978 | Dirksing | |
| 6,443,329 | B1 * | 9/2002 | Rochefort | B65D 5/061 222/105 |
| 9,359,132 | B2 * | 6/2016 | Sullinger | B65D 77/061 |
| 2015/0284181 | A1 * | 10/2015 | Sullinger | B65D 77/061 222/333 |
| 2023/0365297 | A1 * | 11/2023 | Yerly | B65D 75/525 |

(Continued)

FOREIGN PATENT DOCUMENTS

| | | |
|---|---|---|
| EP | 3670382 | 6/2020 |

*Primary Examiner* — Paul R Durand
*Assistant Examiner* — Michael J. Melaragno
(74) *Attorney, Agent, or Firm* — K&L Gates LLP

(57) ABSTRACT

The present invention concerns a recyclable container (1) comprising a cardboard-based socket element (2) and a paper-based receptacle element (3), wherein the receptacle element is connected to the socket element in a way that a product can flow from the receptacle element through the socket element, so that the product can be dispensed by the bulk dispensing device. The container is recyclable with the paper stream.

13 Claims, 3 Drawing Sheets

(56) References Cited

U.S. PATENT DOCUMENTS

| | | | | |
|---|---|---|---|---|
| 2024/0051283 | A1* | 2/2024 | Zimmer | B32B 7/12 |
| 2024/0165936 | A1* | 5/2024 | Zimmer | B65D 65/40 |

* cited by examiner

RECYCLABLE CONTAINER COMPRISING A CARDBOARD-BASED SOCKET ELEMENT AND A PAPER-BASED RECEPTACLE ELEMENT

CROSS REFERENCE TO RELATED APPLICATIONS

The present application is a National Stage of International Application No. PCT/EP2021/075991, filed on Sep. 22, 2021, which claims priority to European Patent Application No. 20199310.2, filed on Sep. 30, 2020, the entire contents of which are being incorporated herein by reference.

FIELD OF THE INVENTION

The present invention relates generally to the field of recyclable food containers. In particular, the present invention relates to food containers suitable for use to refill a bulk dispensing device. An embodiment of the present invention concerns a recyclable container comprising a cardboard-based socket element and a paper-based receptacle element, wherein the receptacle element is connected to the socket element in a way that a product can flow from the receptacle element through the socket element, so that the product can be dispensed by the bulk dispensing device. The container is recyclable with the paper stream.

BACKGROUND OF THE INVENTION

Packaging of manufactured food products is a vital part of the food industry today as it ensures food safety, preserves food quality and plays an important role in production processes, in brand communication and in digitalization. Indeed, several studies show that for a large part of consumers the packaging of a product is one key aspect that drives the purchase decision.

One of the main problems associated with packaging in general is the generation of packaging waste. According to Eurostat in 2017, 172.6 kg of packaging waste was generated per inhabitant in the EU.

The industry addresses this issue by embracing the circular economy. In line with this, the European Commission has recently communicated a new Circular Economy Action Plan (COMMUNICATION FROM THE COMMISSION TO THE EUROPEAN PARLIAMENT, THE COUNCIL, THE EUROPEAN ECONOMIC AND SOCIAL COMMITTEE AND THE COMMITTEE OF THE REGIONSA new Circular Economy Action Plan For a cleaner and more competitive Europe, Brussels, 11.3.2020). Accordingly, the EU needs to accelerate the transition towards a regenerative growth model that gives back to the planet more than it takes, advance towards keeping its resource consumption within planetary boundaries, and therefore strive to reduce its consumption footprint and double its circular material use rate in the coming decade.

One step towards achieving this is to reduce the amount of packaging materials that are used wherever possible.

Bulk dispensing devices can be an effective way to reduce the required packaging material. Bulk dispensing system have a long tradition in retail and have mostly been used for non-food and food items, usually commodities.

One of the key challenges of the use of bulk dispensing devices for food or pet food products in retail today is that hygiene and product quality maintenance must be ensured when the products are distributed, added into the bulk dispensing devices and stored within the bulk dispensing devices before they are dispensed.

Re-filling of the bulk dispensing devices saves packaging material compared to the use of individually packaged goods, as the product to be dispensed can be distributed in bulk formats. While it is possible that the bulk product is distributed in reusable containers, this would require an existing and efficient reverse logistics system. The term "reverse logistics" shall describe the collection of used re-usable bulk containers, returning them to the manufacturer, and to have them cleaned and refilled. Not always is such a reverse logistics system available. Also, not always is the ecological life cycle assessment for a system that involves reverse logistics better than for a system with one-way packaging; in particular, if the re-usable packaging needs a lot of volume and/or if the distance from retailer to manufacturer is very long. Hence, it might be desirable, if the bulk container was a one-way container, that is easily recyclable.

To ensure optimal hygiene it would be further desirable if the personnel in retail would not have to touch the product that is to be added into the bulk dispensing system.

US 2015/0217897 A1 is a US patent application to Graphic Packaging International which discloses a package for holding an article, the package including a liner and a construct attached to the liner. The liner includes an interior space for holding an article. The construct includes a plurality of panels that at least partially reinforce a portion of the liner. The plurality of panels includes top, side and bottom panels. The construct further includes a dispenser comprising dispensing features in at least one of the top panel and the bottom panel for allowing removal of the article from the package. The dispensing features include a dispenser panel at least partially defined by a tear line in the construct and for being at least partially removed to form a dispenser opening. Such a package includes its own openable and reclosable dispensing panel, but does not allow connection to an external dispensing device.

EP 3670382 A1 is a European patent application to Smurfit Kappa France which discloses a bag-in-shell package for connecting to a gravity feed dispenser. The bag-in-shell comprises an inner bag for receiving a bulk material to be dispensed and an outer box made of rigid or semi-rigid material such as cardboard or corrugated cardboard. The bag-in-shell disclosed therein has the drawback that the outer shell is very massive and requires a high amount of material for its manufacturing.

US 2009/0283541 A1 is a US patent application that discloses a system with a pouch to house a pumpable product, a pouch fitment that can be associated with a pump, and an enclosing carton for containing the pouch and fitment. In some embodiments, the system can further comprise a pump operatively connected to the pouch and carton to dispense the pouch contents. The pouch is advantageously configured within the carton in an U-shaped arrangement, allowing the controlled dispensing of a pump-able product. Like in EP 3670382 A1 above, the present system has the drawback that the outer shell is very massive and requires a high amount of material for its manufacturing.

US 2020/0239184 A1 is a US patent application to Graphic Packaging International, that discloses a bag containing a product, said bag being enclosed in a reinforced carton that encloses at least partially said bag. This "partial" bag-in-box opens from the top of said bag in order to dispense the product. It is however not suitable for connection to a dispensing device of any kind in a way that could allow transfer of its contents to the dispensing device.

BE 431533 is a Belgian patent that discloses a pouch for liquid that is partially enclosed in a reinforcing base, and having a dispensing opening extending therefrom. This document provides interesting mechanical reinforcement of a containment pouch, like the solution provided in US'184 cited above, however it does not provide any solution for fitting to an external dispensing device and transferring its contents to such a dispensing device.

Any reference to prior art documents in this specification is not to be considered an admission that such prior art is widely known or forms part of the common general knowledge in the field.

The objective of the present invention is to enrich or improve the state of the art and in particular to provide a recyclable one-way container for bulk products to be sold in retail using a bulk dispensing system that avoids that personnel in retail has to touch the product when re-filling the bulk dispensing system, and that is light weight, suitable for food and pet food products, and easy and efficient to recycle, or to at least provide a useful alternative to solutions that are presently available.

SUMMARY OF THE INVENTION

The inventors were surprised to see that the objective of the present invention could be achieved by the subject matter of the independent claims. The dependent claims further develop the idea of the present invention.

In particular, the objectives set out above are met with a container recyclable in a paper stream recycling process, comprising a cardboard-based socket element and a paper-based receptacle element partially fitted therein, characterized in that:

- the socket element is to be connected to a bulk dispensing device and comprises:
  - an essentially square or rectangular base area,
  - four substantially square or rectangular wall members, each located at each one of the four edges of the base area and extending upwardly therefrom, and being connected to each other to form with the base area a rigid parallelepipedal socket opened at its upper side,
  - a connection element that can be connected to the bulk dispensing device, said connection element comprising a dispensing opening with an area of 50-350 $cm^2$, preferably of 60-90 $cm^2$, said dispensing opening being closed by a frangible membrane made of a paper having a grammage comprised between 30 $g/m^2$ and 150 $g/m^2$,
  - said socket element being rigid and made of cardboard having a grammage comprised between 150 $g/m^2$ and 800 $g/m^2$,
- the receptacle element comprises a closable opening for filling said receptacle element with a product to be dispensed by the bulk dispensing device, and comprises lateral walls and a bottom wall defining a containment volume in the range of 5 to 20 litres, said receptacle element being flexible and having lateral walls made of a paper having a grammage higher than that of the frangible membrane and comprised between 50 $g/m^2$ and 350 $g/m^2$,
- the receptacle element is connected to the socket element in a way that a product can flow from the receptacle element through the connection element of said socket element, so that it can be dispensed by the dispensing device, and
- the ratio between the total weight of the recyclable container and the volume of the receptacle element is less than 15 g/l, preferably less than 8 g/l.

Accordingly, the present invention provides a recyclable container comprising a cardboard-based socket element and a paper-based receptacle element, wherein the socket element comprises a connection element that can be opened when connected to the bulk dispensing device, and the receptacle element is connected to the socket element in a way that a product can flow from the receptacle element through the socket element and through the connection element, so that it can be dispensed by the bulk dispensing device. The container is recyclable with the paper stream.

As used in this specification, the words "comprises", "comprising", and similar words, are not to be interpreted in an exclusive or exhaustive sense. In other words, they are intended to mean "including, but not limited to".

In one possible embodiment of the invention, the socket element further comprises four substantially triangular roof members, or so-called "hopper" members (it is to be noted that "hopper" should be understood as an equivalent of "roof" in the present description, each one of the four triangular hopper members being attached to the top edge of each wall member, folded inwardly and downwardly inside the vicinity of said socket element and being connected with the adjacent hopper members by means of flaps, in order to define a hopper adapted to direct product from the receptacle element towards the dispensing device through the dispensing opening.

The function of the hopper is to allow a maximal amount of the contained product to be dispensed by gravity, so that a neglectable amount of product or no product at all remains within the receptacle element at the time the container is considered "empty" and disconnected from the bulk dispensing device to be replaced by a new one.

The present inventors have shown that the recyclable container in accordance with the present invention allows it to achieve the objective of the present invention. In particular, the container in accordance with the present invention can be connected to a bulk dispensing device via a connecting element so that the product contained in the container can be dispensed through the bulk dispensing device. The socket element is cardboard-based providing sufficient stability to allow for a stable interface with the bulk dispensing system. The receptacle element—that contains the product to be dispensed—is paper-based, allowing that the container has a very light weight—while being recyclable with the paper stream.

BRIEF DESCRIPTION OF THE DRAWINGS

Additional features and advantages of the present invention are described in, and will be apparent from, the description of the presently preferred embodiments which are set out below with reference to the drawings in which.

DETAILED DESCRIPTION OF THE INVENTION

Figure 1A:
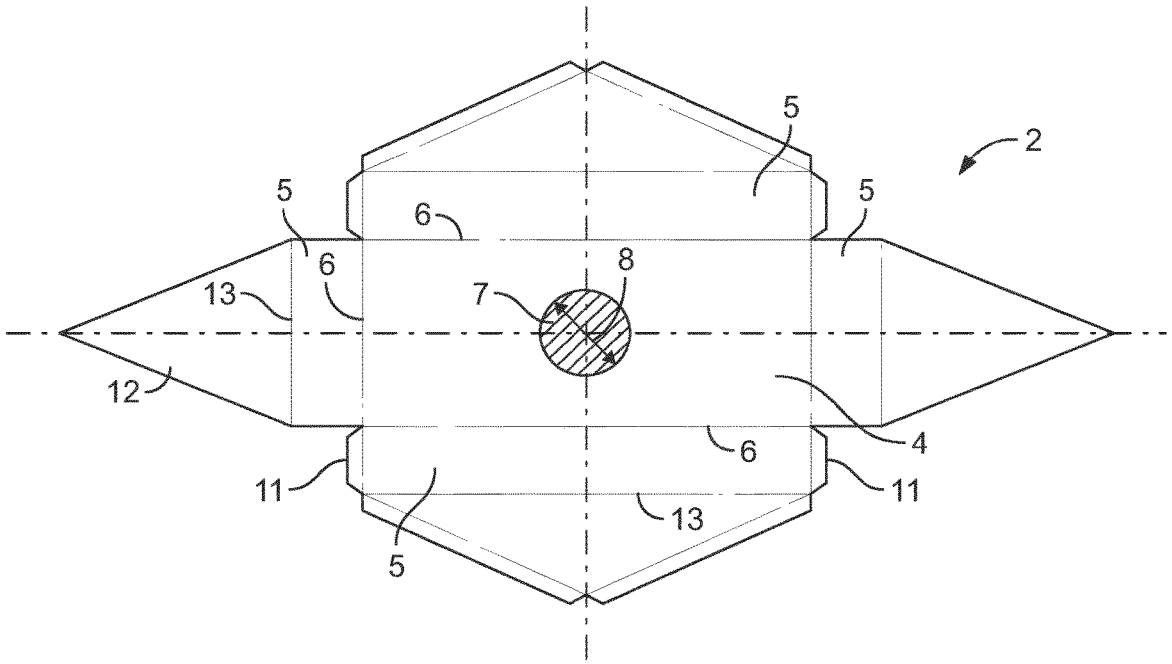
FIG. 1A shows a first embodiment of a flat blank for a socket element in accordance with the present invention.
Figure 1B:
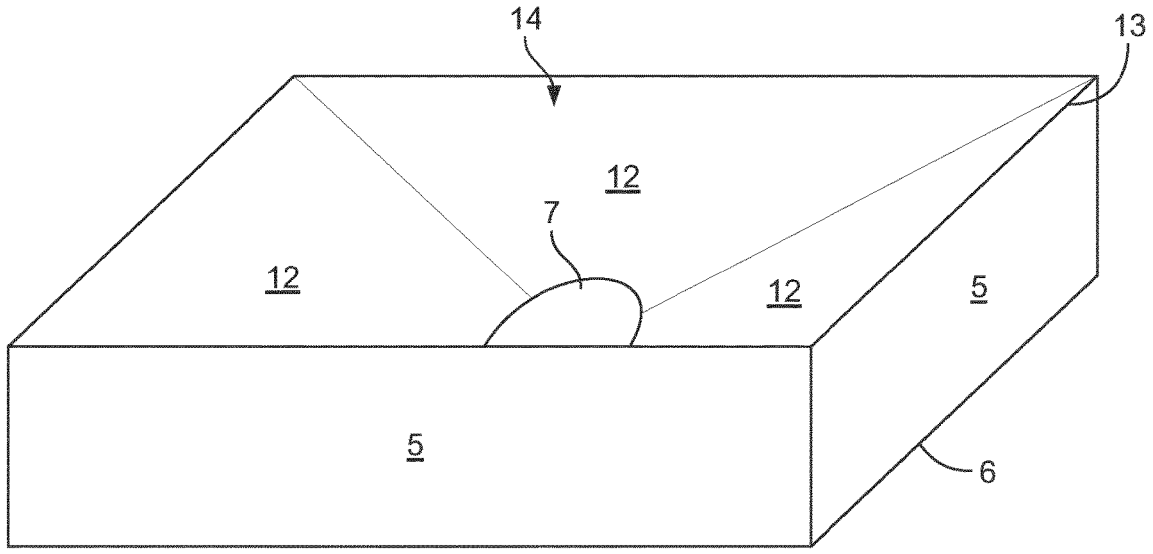
FIG. 1B shows a socket similar to that of FIG. 1A, in the fully folded and formed configuration.
Figure 2:
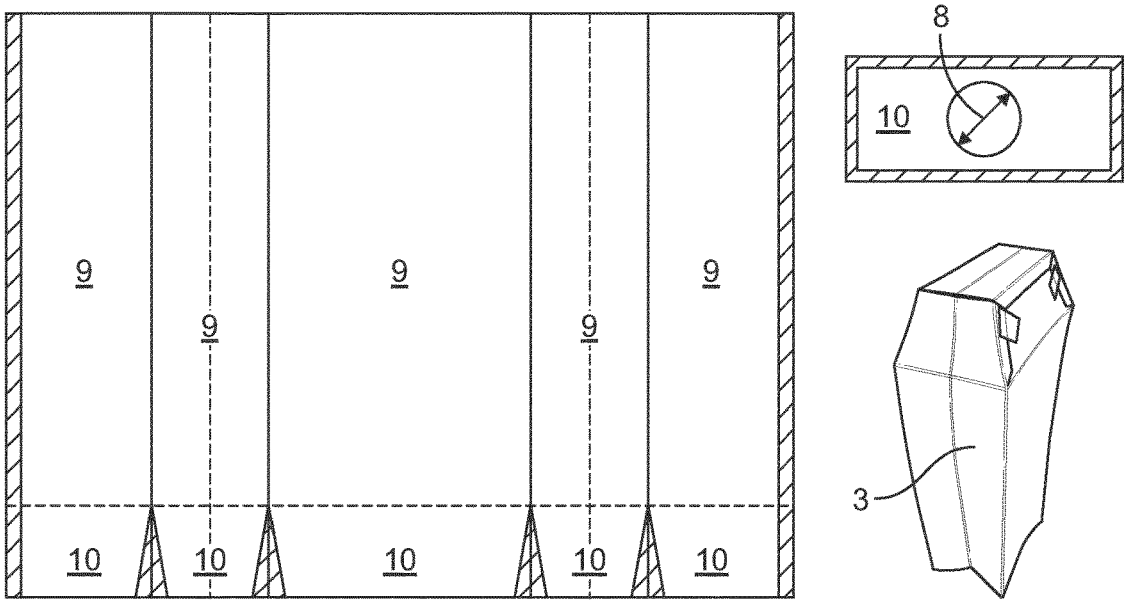
FIG. 2 shows an example of a paper bag ready to be glued on a cardboard socket according to the invention.
Figure 3A:
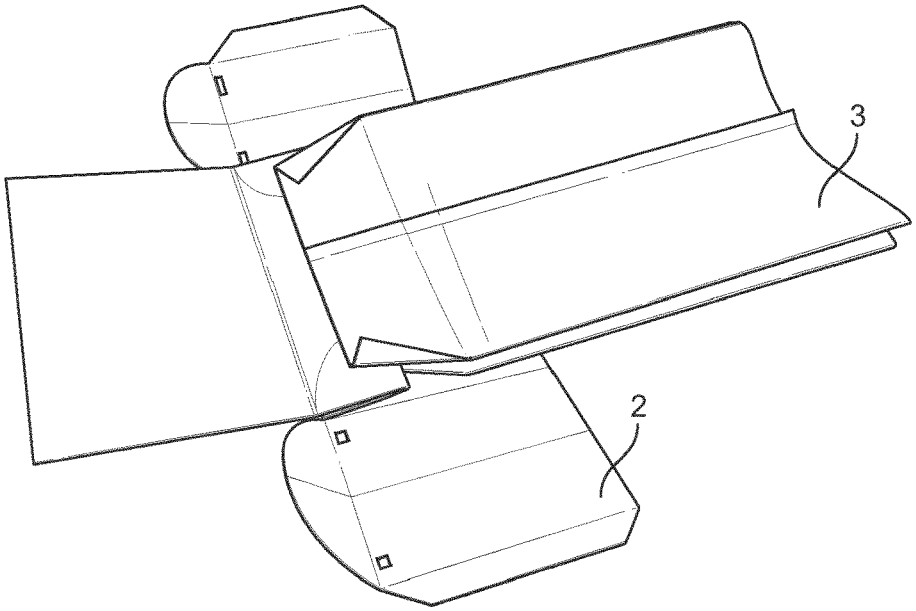
FIG. 3A shows an embodiment of auto erectable cardboard socket glued to a bulk paper bag in the flattened state.
Figure 3B:
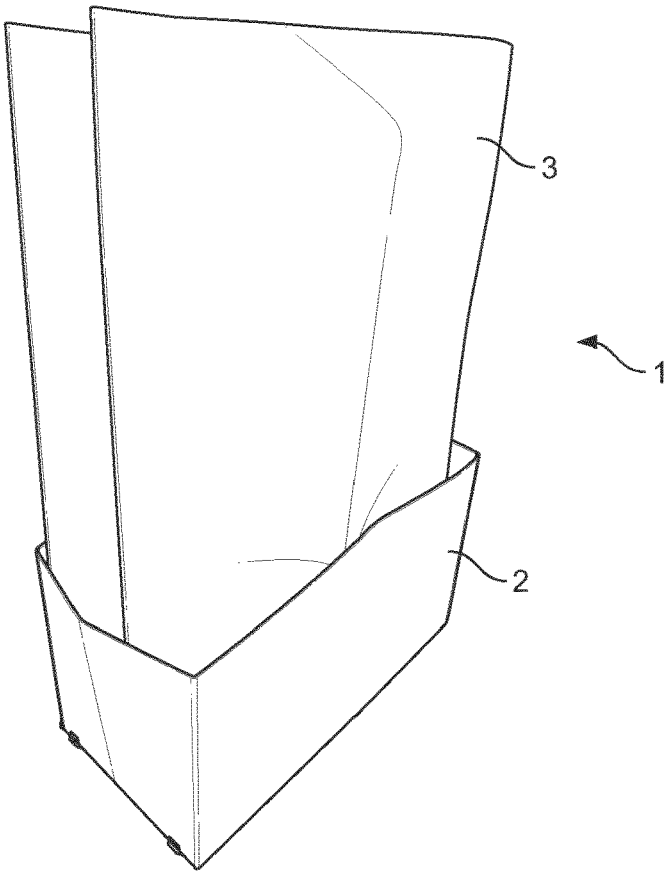
FIG. 3B shows an embodiment of a socket according to FIG. 3A in the erected state.

The present invention, embodiments of which are illustrated in FIGS. 1A, 1B, 2, 3A and 3B and will now be described in reference to said drawings relates to a recyclable container 1, as illustrated in FIG. 3B, comprising a cardboard-based socket element 2 and a paper-based receptacle element 3.

According to the invention, the socket element 2 is to be connected to a bulk dispensing device and comprises:

- an essentially square or rectangular base area 4 (other shapes such as round, avoid, trapezoidal, or other more complex shapes, can be envisaged, if they can be connected to the corresponding shape of a dispensing device, according to the principle of the invention),
- four substantially square or rectangular wall members 5, each located at each one of the four edges 6 of the base area 4 and extending upwardly therefrom, and being connected to each other to form with the base area a rigid parallelepipedal socket 2 opened at its upper side, as illustrated in FIG. 1B and FIG. 3B,
- a connection element, illustrated in FIG. 1A, that can be connected to the bulk dispensing device, said connection element comprising a dispensing opening 7 with an area of 50-350 $cm^2$, preferably of 60-90 $cm^2$, said dispensing opening 7 being closed by a frangible membrane 8 made of a paper having a grammage comprised between 30 $g/m^2$ and 150 $g/m^2$, (in one particularly preferred embodiment of the present invention, the frangible membrane 8 is the bottom wall of the receptacle element 3).

The socket element 2 is rigid (or semi-rigid) and made of cardboard having a grammage comprised between 150 g/m2 and 800 g/m2.

The receptacle element 3 comprises a closable upper opening for filling said receptacle element with a product to be dispensed by the bulk dispensing device, and comprises lateral walls 9 and a bottom wall 10 defining a containment volume in the range of 5 to 20 litres. Said receptacle element 3 is flexible and has lateral walls made of a paper having a grammage higher than that of the frangible membrane and comprised between 50 g/m2 and 350 g/m2.

The receptacle element 3 is connected to the socket element 2 in a way that a product can flow from the receptacle element through the connection element of said socket element, so that it can be dispensed by the dispensing device. For this, the frangible membrane 8 is pierced during connection of the recycle container 1 to a dispensing device. Piercing of the frangible membrane opens the dispensing opening 7 and establishes a connection between the interior of the receptacle 3, and the dispensing device, to allow product contained within the receptacle to flow towards the dispensing device, for instance by gravity. The dispensing device comprises a dosing device that starts and stops the flow of product therefrom. In a preferred embodiment, piercing of the frangible membrane is actuated by a sharp element of the dispensing device, like a cylindrical cutter or blade, that is able to pierce through said frangible membrane at the time the recyclable container 1 is connected to said dispensing device.

The ratio between the total weight of the recyclable container and the volume of the receptacle element is less than 15 g/l, preferably less than 8 g/l.

Bulk dispensing devices are well known in the art. In the field of food, they are frequently used, for example for sweets or nuts in retail, or for breakfast cereals in hotels, for example. In an effort to reduce packaging they are recently increasingly used, both, as permanently installed bulk dispensing devices, or as movable bulk dispensing devices, for example, bulk dispensing devices installed on movable vehicles. Usually, they comprise a reservoir containing a supply of the product to be dispensed and a dispenser compartment communicating with said reservoir so that the product can be dispensed by that dispenser compartment. The reservoir can be made from any material, but is usually made from metal, plastics, glass and/or wood and needs to be regularly cleaned.

In one embodiment of the present invention the recyclable container is designed, so that it fits into the reservoir. The connection element in the socket element may be connectable to the dispenser compartment of the bulk dispensing device, holding the container in accordance with the present invention in place. The fact that the container is fitted into the reservoir has the advantage that the cleaning step of the reservoir needs to be carried out less often or even becomes unnecessary. Also, the risk of contaminating the product by an improperly cleaned reservoir is significantly reduced or even avoided.

The fact that the socket element is cardboard-based has the consequence that the socket element is much more stable than a paper-based socket element would be. Accordingly. The container of the present invention can have a stable and defined position in the reservoir of the bulk dispensing device ensuring constant product supply and no issues with reliable product dosing.

A connection element is part of the socket element and contributes to the connection between socket element of the container of the present invention and dispenser compartment of the bulk dispensing system. Advantageously the connection element can be opened or opens automatically, when it is connected to the dispenser compartment of the bulk dispensing device. This can be achieved, for example, when the connection element comprises a perforated element which is displaced, when the connection is made between connection element and dispenser compartment.

The receptacle element is the element of the recyclable container of the present invention that comprises the product to be dispensed. For example, the bottom of the receptacle element may be connected to the socket element and the top of the receptacle element may comprise an opening through which the container of the present invention can be filled with product. After filling, the opening may be closed by any means known in the art. For example, the inside of the receptacle element may be coated with a sealing layer, for example with a hot seal layer or a cold seal layer, so that the opening may be closed after filling. Further, for example, the paper-based receptacle element can be closed by means of heat and pressure or hot melt gluing.

The receptacle element may be dimensioned so that it fits into the bulk dispensing device, for example into the reservoir of the bulk dispensing device. It may also be dimensioned so that it fits on top of the bulk dispensing device, so that the recyclable container represents the reservoir of the bulk dispensing device.

The receptacle element may be connected to the socket element so that the socket element is connected to the bottom of the receptacle element. This has the advantage that gravity can be the driving force that allows emptying of the receptacle element through the socket element and through the connection element into the bulk dispensing device, for example the dispenser compartment. Receptacle element and socket element may be connected by any means known in the art. For example, the receptacle element may be glued to the socket element. Hence, the receptacle element may be connected to the socket element in a way that the floor of the receptable element is connected to the top of the socket element and that opening the connection element involves piercing the bottom of the receptable element to that the product contained in the receptable element can be dispensed.

Importantly, the container of the present invention is recyclable with the paper stream. This way, no reverse logistics is required. Moreover, paper recycling is very efficient and widely available.

The recyclable container in accordance with the present invention may be used to package any kind of products, preferably dry products. For example the product may be in particulate, powder or granulated form. A product may be considered as dry if it has a moisture content of below 10 weight-%.

For example, the container may be for use in providing packaged food or pet food products for use in dispensing food or pet food products in bulk dispensing devices, for example in retail.

In accordance with Codex Alimentarius the term "food" shall mean any substance, whether processed, semi-processed or raw, which is intended for human consumption, and includes drink, chewing gum and any substance which has been used in the manufacture, preparation or treatment of "food" but does not include cosmetics or tobacco or substances used only as drugs.

The term "pet food" shall mean any substance, whether processed, semi-processed or raw, which is intended for pet consumption, and includes any substance which has been used in the manufacture, preparation or treatment of "pet food".

The paper-based receptacle element may be made from a multi-layer paper-based material. For example, the paper-based receptacle element may be made from a paper layer comprising at least one barrier coating, for example a barrier coating selected from the group consisting of ethylene acrylic acid copolymer, polyvinyl acetate, polyvinylidene dichloride, polyurethane, ethyl vinyl alcohol, polyvinyl alcohol, ethyl butyl alcohol, vinyl acetate, a thin inorganic layer obtained by means of vacuum deposition, or combinations thereof.

Using multi-layer paper-based materials has the advantage that such multi-layer paper-based material have certain barrier properties that allow to protect the product that is packaged in the receptable element. For example, the multi-layer paper-based-material may comprise a metallized layer. Such multi-layer paper-based-material comprising a metallized layer, for example an aluminium layer, are recyclable with the paper stream, and the metallized layer ensures a good water vapor transmission rate (WVTR) and a good oxygen transmission rate (OTR). The paper-based material may also comprise further layers, for example, to stabilize the metallized layer and/or to improve the barrier properties of the paper-based material. For example, the paper-based receptacle element may made from a multi-layer paper-based material with a water vapor transmission rate (WVTR) in the range of about 0.5-100 g/($m^2$·day·bar) at 38° C. and 90% RH, and an oxygen transmission rate in the range of about 0.5-100 ml/($m^2$·day·bar) at 23° C. and 50% RH.

The receptacle element of the recyclable container in accordance with the present invention may be made from a paper with a grammage in the range of about 80-180 g/m2, for example in the range of about 100-140 g/$m^2$. The paper-based receptacle element may be made from an unbleached virgin kraft extensible or semi-extensible paper, for example with a back side precoating composed of a pigment-binder precoat. Such a precoating can help to smoothen the surface and to reduce porosity. The paper-based receptacle element may further comprise a last coating layer on its inside which may have a heat seal functionality with a resulting seal strength of 5-15 N/15 mm, for example 7-10 N/15 mm.

The recyclable container can have any volume that allows to fill the reservoir of the bulk dispensing device. At the same time, the material of the container in accordance with the present invention must be stable enough that it can safely hold the required volume of the product. The inventors have achieved excellent results when the recyclable container had a volume in the range of about 5000-20000 $cm^3$ (i.e. 5 to 20 litres), for example in the range of 7500 to 12500 $cm^3$ (i.e. 7.5 to 12.5 litres).

Shipping of the filled recyclable container of the present invention should be carried out with as little void volume as possible. This can be achieved when the filled recyclable container of the present invention has an essentially cuboid form. Recyclable containers in a cuboid forms also have the advantage that they fit into the reservoirs or can serve as reservoirs for most bulk dispensing devices. Hence, in one embodiment of the present invention, the recyclable container has a substantially cuboid shape with a substantially rectangular base area.

As discussed above, the receptacle element of the recyclable container in accordance with the present invention may be connected to the socket element and opening the connection element involves piercing the bottom of the receptable element so that the product contained in the receptable element can be dispensed. In order to ensure that dispensing the product works well, it may be helpful if the container of the present invention is well aligned with the bulk dispensing device, and, in particular, with the dispenser compartment of the bulk dispensing device. This may be achieved if the socket element interacts with the bulk dispensing device in a way that the container of the present invention is secured in place. This may be achieved by interaction means that interact with the bulk dispensing device. For example, such interaction means may be a part of the connection element. Hence, the socket element, for example the connection element, may comprise means that interact with the bulk dispensing device to hold the container in place on top of or within the bulk dispensing device, for example within the reservoir of the bulk dispensing device. The means that interact with the bulk dispensing device may be selected from the group consisting of pins, flaps, a sealing opening, or combinations thereof.

The connection element in the socket element can be opened when connected to the bulk dispensing device. The opening will have a size that is large enough to allow the product to flow from the receptacle element through the socket element and through the connection element, so that it can be dispensed by the bulk dispensing device. The size of the opening will depend on the geometry of the bulk dispensing device, the nature of the product to be dispensed and the amount of product that is typically dispensed. The opening may be a part of the connection element. For example, the connection element may comprise an area that can be opened with a size in the range of 50-350 $cm^2$, for example 60-90 $cm^2$.

The area that can be opened can have any shape. The inventors have obtained good results if the opening has a simple shape, as simple shapes were found to be more stable and easier to open than complex shapes. Furthermore, socket elements with a connection element with an area that can be opened with a simple shape were found to be easier to produce. Consequently, it may be preferred that the connection element comprises an area that can be opened with a substantially round, rectangular or quadratic shape.

The recyclable container of the present invention is manufactured from paper-based and cardboard-based material. This material must be as light as possible to reduce material usage and energy usage during transport, yet strong enough to ensure safe interaction with the bulk dispensing device and to package the product to be dispensed reliably. To achieve this, the inventors have achieved very good results with a socket element, wherein the cardboard-based material of the socket element had a grammage in the range of about 50-800 g/m$^2$ and/or with a receptacle element wherein the paper-based material of the receptable element had a grammage in the range of about 50-350 g/m$^2$.

The inventors have obtained good results in terms of lipid barrier properties, for example, when the paper-based receptacle element of the recyclable container in accordance with one of the preceding claims, was made from a paper layer which comprised at least one layer of extrusion and/or adhesive laminated plastic layer comprising PE, PE-EVOH-PE, LDPE, LLDPE, PP, BOPP, PET, mPET; EVOH, or a combination of thereof.

The socket element may be made from a folding box board material, for example a folding box board material with a grammage in the range of about 300-500 g/m$^2$. The socket element may also be made from a corrugated or microflute material with a maximum thickness in the range of about 1-7 mm, preferably in the range of about 3-5 mm and a grammage in the range of about 250-800 g/m$^2$.

In one embodiment, the recyclable container can be folded when empty to be essentially flat. This has the advantage that empty containers in accordance with the present invention can be easily shipped and require little volume. Further, this has the advantage that after the container has been used and emptied it can be folded so that it requires little volume when it is transported to the paper recycling stream.

For example, in the recyclable container in accordance with the present invention, the socket element may comprise:

- an essentially rectangular base area with the connection element being located at its centre,
- a substantially rectangular wall member located at each edge of the base area, the four wall members having substantially the same height and being connectable with each other, for example, by means of flaps,
- a substantially triangular roof member attached to the top of each wall member, the four triangular roof members being connectable with each other, for example, by means of flaps, wherein the substantially triangular roof members are excised in a way that at least a part of the area that can be opened in the connection element remains uncovered after the four triangular roof members are connected with each other.

The subject matter of the present invention also extends to a blank for the socket element 2 of a recyclable container 1 in accordance with the present invention. As illustrated in FIG. 1A, in one embodiment of the invention, the blank for the socket element comprises:

- an essentially rectangular base area 4 with the connection element being located at its centre,
- four substantially rectangular wall members 5 located at each edge of the base area, the four wall members 5 having substantially the same height and being connectable with each other, for example, by means of flaps 11,
- four substantially triangular "roof" members, otherwise named "hopper" members 12 attached to the top of each wall member 5, the four triangular roof or "hopper" members 12 being connectable with each other, for example, by means of flaps; the triangular roof ("hopper") members 12 are excised (i.e. cut) in a way such that the dispensing opening 7 of the connection element remains uncovered after the four triangular roof members are folded and connected with each other (i.e. when the hopper is formed, as shown in FIG. 1B). this, of course, guarantees that the tip of the triangles forming the hopper faces, do not obstruct the passage of product through the dispensing opening 7, once the recyclable container 1 is connected functionally to a dispensing device.

As described herein before, the substantially triangular roof members 12 are also named "triangular hopper members 12" and form, when they are folded around edges 13 and connected to one another, a hopper 14 illustrated in FIG. 1B, said hopper having the general shape of an inverted pyramid, the large cross-section of which being located adjacent to the peripheral upper edges of the cardboard socket, said inverted pyramid-shaped hopper extending downwardly inside the vicinity of the socket 2, and its smaller cross-section (i.e. close to the tip of the pyramid), joining the edges of the dispensing opening 7 of the socket 2, as shown in FIG. 1B.

The function of the hopper 14 is to allow a maximal amount of the contained product to be dispensed by gravity, so that a neglectable amount of product or no product at all remains within the receptacle element at the time the container is considered "empty" and disconnected from the bulk dispensing device to be replaced by a new one.

The receptacle element may have a floor shaped in a way that allows it that the receptable element is connected tightly to the roof of the socket element. For example, the bottom of the receptacle element and the roof of the socket element may fit together like plug and socket. This can be achieved, for example, if the bottom of the receptacle element has a "negative" pyramidal shape that matches the "positive" pyramidal shape of the roof of the socket element.

Figure 1C:
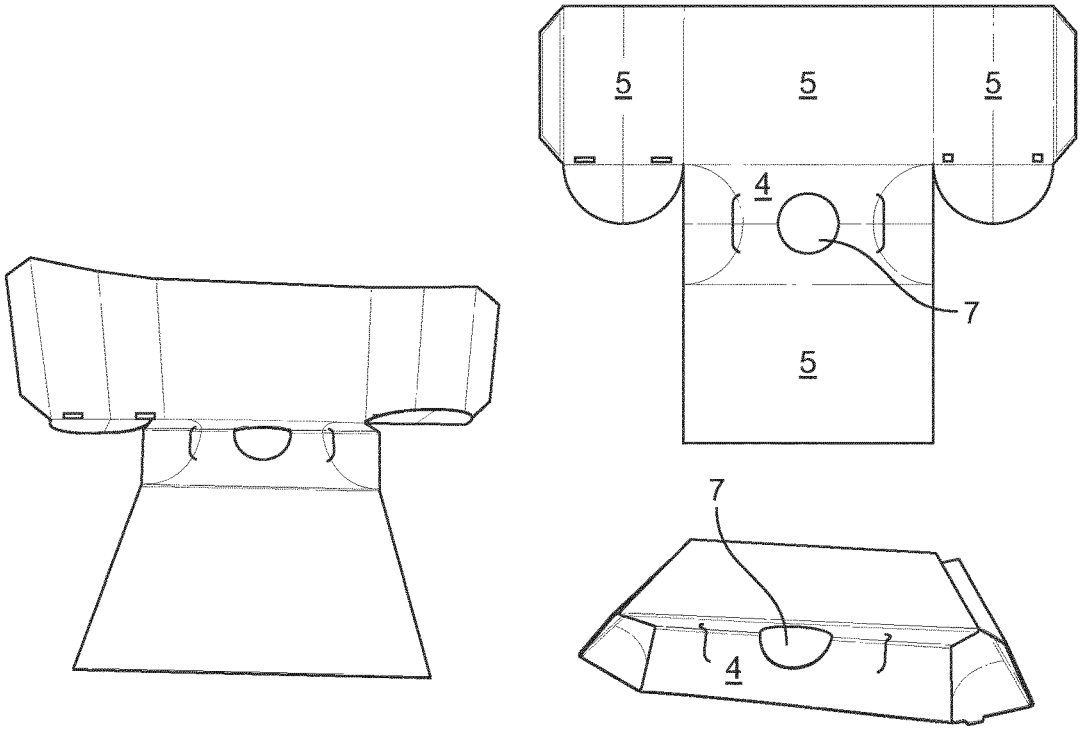
FIG. 1C shows an auto-erectable die cut for a second embodiment of a cardboard socket according to the invention.

An alternative socket element is shown in FIG. 1C. This socket element comprises:

- an essentially rectangular base area with the connection element 1 being located at its centre, with central edges of said connection element,
- two substantially rectangular wall member located at two opposite edges of the base area, two further wall members located on the right and on the left side of one of the aforementioned rectangular wall member, or two further wall members located at the right sides of both aforementioned rectangular wall members, or two further wall members located at the left sides of both aforementioned rectangular wall members; the four wall members having substantially the same height and being connectable with each other and with the base area, for example, by means of flaps.

In one embodiment of the present invention the base element and two opposite wall members comprise a fold, so that the socket element can be compressed to a flat state.

This is useful, for example when the socket element is to be transported in an empty state. The socket element can then—after transport—be auto erected, by unfolding the folds. Hence, one advantage of this embodiment of the present invention is that the socket element is auto erectable.

One advantage of the socket element of the recyclable container of the present invention is that it allows a constant flow of product through the connection element without the build-up of residual product that hinders emptying of the recyclable container of the present invention and/or stays in the container after emptying, creating unwanted product waste.

One advantage of the recyclable container of the present invention is that its usage eliminates the need for reverse logistics. Consequently, the recyclable container may be to be distributed in a filled form and may be to be recycled after usage.

In the recyclable container in accordance with the present invention the receptacle element may be irreversibly connected to the socket element in a way that a product can flow from the receptacle element through the socket element and through the connection element, so that it can be dispensed by the dispensing device.

The irreversible connection may be achieved by any means known in the art, for example through gluing. For this, the recyclable container of the present invention may be manufactured on an automatic gluing line. Automatic gluing may be achieved through the application of a hot melt glue. Such a glue may be applied onto the socket element and/or onto the receptacle element. Gluing may then be achieved through the application of pressure while solidifying the glue.

Once receptacle element and socket element are assembled, for example by means of gluing, the recyclable container in accordance with the present invention may be automatically erected, for example to be filled on a filling line.

One advantage of the recyclable container in accordance with the present invention is that the recyclable container can be assembled on an automatic continuous folding-gluing line by pre-breaking the carton blanks and gluing them to form an essentially flat tray with a consequent insertion of the preformed paper bag element so that paper bag element is attached to the afore-formed carton tray by high-precision gluing, for example by using 4 to 10 gluing points, for example by the dotted or striped application of a hot melt adhesive so that bag and tray cannot be further separated without losing the structural integrity of the paper bag.

Those skilled in the art will understand that they can freely combine all features of the present invention disclosed herein. In particular, features described for the product of the present invention may be combined with the use of the present invention and vice versa. Further, features described for different embodiments of the present invention may be combined.

Although the invention has been described by way of example, it should be appreciated that variations and modifications may be made without departing from the scope of the invention as defined in the claims.

Furthermore, where known equivalents exist to specific features, such equivalents are incorporated as if specifically referred in this specification. Further advantages and features of the present invention are apparent from the figures and non-limiting examples.

Examples

Foldable paper bags were produced from of a reel of 100 g/m$^2$ of unbleached kraft paper coated with 30 μm HDPE by an extrusion coating process. In order to build one of these bags, two rectangular pieces of paper were cut out from the reel: one large piece with a length of 740 mm and a width of 450 mm and a smaller piece with a length of length 210 mm and a width of 80 mm, as shown on FIG. 2. The smaller piece will form the bottom flat face of the bag, this is the face that is eventually glued onto the erectable socket.

The larger piece is used to make the lateral faces of the bag. It is first sealed along its length in order to make a tube, then a rectangular section is given to the tube by forming the corners at the proper locations. At this stage the tube has a rectangular section of 245 mm by 115 mm. On one side of this rectangular tube, the section dimension is reduced by sealing the corners onto themselves as shown in FIG. 2. At this end of the bag the opening is now a rectangle of about 200 mm by 70 mm. The second piece of paper with a dimension of 210 mm by 80 mm is now used to close this opening. It is glued or heat sealed onto the inside of the bag in such a way that it closes the bag while forming a flat surface area that can be eventually be glued to the erectable cardboard socket.

Auto erectable cardboard sockets were produced out of corrugated cardboard with 125 g/m$^2$ Kraft paper on each side and a thin fluting in-between (approximately 2 mm thick) following the drawing of FIG. 1B (see die cut on the right-hand side). The dark grey line on the die cut represents where cardboard is cut while the light grey line represents where the cardboard is folded. The cardboard was folded as described on the left-hand side of FIG. 1, then assembled and glued to form the socket.

The paper bags and the cardboard sockets were glued together as shown in FIGS. 3A and 3B.

Several paper bags and cardboard sockets have been filled with dry petfood, dry food (soluble coffee), dry fatty food (baking chocolate) and then were sealed.

These filled bags were placed on a commercially available bulk dispensing device. The paper bag was perforated using the circular knife of the bulk dispensing device and the products could be dispensed.

Pet food: A recyclable container in accordance with the present invention was produced, wherein the paper-based receptacle element was made from a paper with a resilient physical grease barrier made of one or several polymeric coatings. The coatings were selected from the group consisting of LDPE, LLDPE, PP, BOPP, PET, mPET; EVOH, or a combination of thereof. The resulting container has passed a grease resistance test.

Powdered beverage: A recyclable container in accordance with the present invention was produced, wherein the paper-based receptacle element was made from a paper with a water vapor transmission rate (WVTR) measured at 38° C. and 90% RH in the range of 0.5-2 g/m$^2$/day and oxygen transmission rate (OTR) measured at 23° C. and 50% RH of 10-100 cc/m$^2$/day.

Chocolate: A recyclable container in accordance with the present invention was produced, wherein the paper-based receptacle element was made from a paper with a WVTR measured at 38° C. and 90% RH in the range of 0.5-2 g/m$^2$/day and OTR measured at 23° C. and 50% RH of 100-250 cc/m$^2$/day. the resulting container has passed a grease resistance test.

The invention claimed is:

1. A container recyclable in a paper stream recycling process, comprising a cardboard-based socket element and a paper-based receptacle element partially fitted therein, wherein:

the socket element is to be connected to a bulk dispensing device and comprises:

an essentially square or rectangular base area, four substantially square or rectangular wall members, each located at each one of the four edges of the base area and extending upwardly therefrom, and being connected to each other to form, with the base area, a rigid parallelepipedal socket opened at its upper side, a connection element that can be connected to the bulk dispensing device, said connection element comprising a dispensing opening with an area of 50-350 $cm^2$, preferably of 60-90 $cm^2$, said dispensing opening being closed by a frangible membrane made of a paper having a grammage of between 30 $g/m^2$ and 150 $g/m^2$, said socket element being rigid and made of cardboard having a grammage comprised of between 150 $g/m^2$ and 800 $g/m^2$, the receptacle element comprises a closable opening for filling said receptacle element with a product to be dispensed by the bulk dispensing device, and comprises lateral walls and a bottom wall defining a containment volume of 5 to 20 litres, said receptacle element being flexible and having lateral walls made of a paper having a grammage greater than that of the frangible membrane and between 50 $g/m^2$ and 350 $g/m^2$, the receptacle element is connected to the socket element in a way that a product can flow from the receptacle element through the connection element of said socket element, so that it can be dispensed by the dispensing device, and the ratio between the total weight of the recyclable container and the volume of the receptacle element is less than 15 g/l.

2. Recyclable container in accordance with claim 1, wherein the container is for use in providing packaged food or pet food products for use in dispensing food or pet food products in bulk dispensing devices.

3. Recyclable container in accordance with claim 1, wherein the paper-based receptacle element is made from a paper layer comprising at least one barrier coating.

4. Recyclable container in accordance with claim 1, wherein the recyclable container has a volume of 7.5 to 12.5 litres.

5. Recyclable container in accordance with claim 1, wherein the recyclable container has a substantially cuboid shape with a substantially rectangular base area.

6. Recyclable container in accordance with claim 1, wherein the receptacle element is connected to the socket element in a way that the floor of the receptable element is connected to the top of the socket element and that opening the connection element involves piercing the bottom of the receptable element to that the product contained in the receptable element can be dispensed.

7. Recyclable container in accordance with claim 1, wherein the socket element comprises a member that interacts with the bulk dispensing device to hold the container in place on top or within the bulk dispensing device, said member being selected from the group consisting of pins, flaps, sealing opening, and combinations thereof.

8. Recyclable container in accordance with claim 1, wherein the connection element comprises an area that can be opened with a substantially round, rectangular or quadratic shape.

9. Recyclable container in accordance with claim 1, wherein the recyclable container can be folded when empty to be essentially flat.

10. Recyclable container in accordance with claim 1, wherein the socket element further comprises four substantially triangular hopper members, each one attached to the top edge of each wall member, folded inwardly and downwardly inside the vicinity of said socket element and being connected with the adjacent hopper members by use of flaps, to define a hopper adapted to direct product from the receptacle element towards the dispensing device through the dispensing opening.

11. Recyclable container in accordance with claim 1, wherein the bottom wall of the receptacle element is connected to the rectangular base area of the socket element, at least in the periphery of the connection element's dispensing opening.

12. Recyclable container in accordance with claim 1, wherein the connection element is located at the centre of the base area of the socket element.

13. Recyclable container according to claim 1, wherein the four wall members of the socket element have substantially the same height.

* * * * *